US006985142B1

(12) United States Patent
Svensson et al.

(10) Patent No.: US 6,985,142 B1
(45) Date of Patent: Jan. 10, 2006

(54) POWER-EFFICIENT, PULSED DRIVING OF CAPACITIVE LOADS TO CONTROLLABLE VOLTAGE LEVELS

(75) Inventors: Lars G. Svensson, Gothenburg (SE); William C. Athas, Redondo Beach, CA (US); Rajat K. Lal, Culver City, CA (US)

(73) Assignee: University of Southern California, Los Angeles, CA (US)

( * ) Notice: Subject to any disclaimer, the term of this patent is extended or adjusted under 35 U.S.C. 154(b) by 0 days.

(21) Appl. No.: 09/389,841

(22) Filed: Sep. 3, 1999

Related U.S. Application Data

(60) Provisional application No. 60/099,120, filed on Sep. 3, 1998, provisional application No. 60/143,665, filed on Jul. 14, 1999.

(51) Int. Cl.
*G09G 5/00* (2006.01)

(52) U.S. Cl. ..... 345/211; 345/50; 345/87

(58) Field of Classification Search ..... 345/207, 345/204, 205, 208, 210, 211–213, 36, 75.2, 345/76, 80, 87, 90, 92, 98–100, 50; 307/109, 307/110, 112, 125–127; 363/60
See application file for complete search history.

(56) References Cited

U.S. PATENT DOCUMENTS

| | | | | |
|---|---|---|---|---|
| 3,603,898 A | | 9/1971 | Dawson et al. | 333/70 |
| 3,654,537 A | | 4/1972 | Coffey | 320/1 |
| 4,082,430 A | | 4/1978 | Schulthess et al. | 350/333 |
| 4,107,757 A | | 8/1978 | Masuda et al. | 361/235 |
| 4,109,192 A | | 8/1978 | Burbank et al. | 320/1 |
| 4,328,525 A | | 5/1982 | Allen et al. | 361/152 |
| 4,594,589 A | | 6/1986 | Ohba et al. | 340/805 |
| 4,605,999 A | | 8/1986 | Bowman et al. | 363/19 |
| 4,707,692 A | | 11/1987 | Higgins et al. | 340/805 |
| 4,739,320 A | * | 4/1988 | Dolinar et al. | 345/212 |
| 4,802,739 A | | 2/1989 | Iwamoto | 350/332 |
| 4,818,981 A | | 4/1989 | Oki et al. | 340/784 |
| 4,862,113 A | | 8/1989 | Buhler et al. | 331/117 |
| 4,893,117 A | | 1/1990 | Blomley et al. | 340/784 |
| 4,920,474 A | | 4/1990 | Bruning et al. | 363/97 |
| 5,051,668 A | | 9/1991 | Kawaberi et al. | 315/408 |
| 5,063,340 A | | 11/1991 | Kalenowsky | 320/1 |
| 5,095,223 A | | 3/1992 | Thomas | 307/110 |
| 5,105,288 A | | 4/1992 | Senda et al. | 359/57 |
| 5,107,136 A | | 4/1992 | Stekelenburg | 307/269 |
| 5,126,589 A | | 6/1992 | Renger | 307/270 |
| 5,150,013 A | | 9/1992 | Bobel | 315/209 |

(Continued)

FOREIGN PATENT DOCUMENTS

EP 0 755 044 A1 7/1996

(Continued)

OTHER PUBLICATIONS

Kim, Jong-Seok, Deog-Kyoon Jeong and Gyudong Kim, "A Multi-Level Multi-Phase Charge-Recycling Method for Low-Power AMLCD Column Drivers," *IEEE Journal of Solid State Circuits,* vol. 1, Jan. 2000, 12 pages.

(Continued)

*Primary Examiner*—Henry N. Tran
(74) *Attorney, Agent, or Firm*—McDermott Will & Emery LLP

(57) ABSTRACT

Power-efficient, pulsed driving of capacitive loads to controllable voltage levels, with particular applicability to LCDs. Energy stored in a portion of the capacitive load is recovered during a recovery phase. Time-varying signals are used to drive the load and to recover the stored energy, thus minimizing power losses, using processes named adiabatic charging and adiabatic discharging.

41 Claims, 7 Drawing Sheets

U.S. PATENT DOCUMENTS

| | | | | | |
|---|---|---|---|---|---|
| 5,206,632 | A | | 4/1993 | Dupont et al. | 340/784 |
| 5,247,376 | A | | 9/1993 | Wakai | 359/55 |
| 5,264,752 | A | | 11/1993 | Savicki | 310/316 |
| 5,293,082 | A | | 3/1994 | Bathaee | 307/270 |
| 5,339,236 | A | | 8/1994 | Tamagawa | 363/59 |
| 5,349,366 | A | | 9/1994 | Yamazaki et al. | 345/92 |
| 5,396,527 | A | * | 3/1995 | Schlecht et al. | 257/235 |
| 5,459,414 | A | | 10/1995 | Dickinson | 326/93 |
| 5,465,054 | A | | 11/1995 | Erhart | 326/34 |
| 5,473,269 | A | | 12/1995 | Dickinson | 326/93 |
| 5,473,526 | A | * | 12/1995 | Svensson et al. | 307/109 |
| 5,506,520 | A | | 4/1996 | Frank et al. | 326/96 |
| 5,508,639 | A | | 4/1996 | Fattaruso | 326/97 |
| 5,510,748 | A | | 4/1996 | Erhart et al. | 327/530 |
| 5,517,145 | A | | 5/1996 | Frank | 327/201 |
| 5,521,538 | A | | 5/1996 | Dickinson | 326/93 |
| 5,526,319 | A | | 6/1996 | Dennard et al. | 365/226 |
| 5,528,256 | A | | 6/1996 | Erhart et al. | 345/96 |
| 5,559,463 | A | | 9/1996 | Denker et al. | 327/300 |
| 5,559,478 | A | * | 9/1996 | Athas et al. | 307/108 |
| 5,572,211 | A | | 11/1996 | Erhart et al. | 341/144 |
| 5,578,957 | A | | 11/1996 | Erhart et al. | 327/333 |
| 5,600,461 | A | * | 2/1997 | Ueda et al. | 349/38 |
| 5,602,497 | A | * | 2/1997 | Thomas | 326/93 |
| 5,604,449 | A | | 2/1997 | Erhart et al. | 326/81 |
| 5,604,454 | A | | 2/1997 | Maguire et al. | 327/112 |
| 5,657,039 | A | | 8/1997 | Mizukata et al. | 345/95 |
| 5,675,263 | A | | 10/1997 | Gabara | 326/97 |
| 5,694,445 | A | | 12/1997 | Hirano et al. | 377/57 |
| 5,706,023 | A | * | 1/1998 | Nagata et al. | 345/92 |
| 5,734,285 | A | | 3/1998 | Harvey | 327/291 |
| 5,748,165 | A | | 5/1998 | Kubota et al. | 345/96 |
| 5,754,156 | A | | 5/1998 | Erhart et al. | 345/98 |
| 5,818,252 | A | | 10/1998 | Fullman et al. | 324/765 |
| 5,821,923 | A | | 10/1998 | Van Amesfoort et al. | 345/212 |
| 5,838,203 | A | | 11/1998 | Stamoulis et al. | 331/1 A |
| 5,838,289 | A | | 11/1998 | Saito et al. | 345/79 |
| 5,841,299 | A | | 11/1998 | De | 326/98 |
| 5,852,426 | A | * | 12/1998 | Erhart et al. | 345/209 |
| 5,861,861 | A | | 1/1999 | Nolan et al. | 345/87 |
| 5,870,331 | A | | 2/1999 | Hwang et al. | 365/154 |
| 5,880,602 | A | | 3/1999 | Kaminaga et al. | 326/81 |
| 5,881,014 | A | | 3/1999 | Ooishi | 365/226 |
| 5,883,538 | A | | 3/1999 | Keeth et al. | 327/333 |
| 5,889,439 | A | | 3/1999 | Meyer et al. | 331/17 |
| 5,892,540 | A | | 4/1999 | Kozlowski et al. | 348/300 |
| 5,896,117 | A | | 4/1999 | Moon | 345/95 |
| 5,900,854 | A | | 5/1999 | Itoh et al. | 345/99 |
| 5,943,030 | A | * | 8/1999 | Minamibayashi | 315/169.3 |
| 5,986,476 | A | * | 11/1999 | De | 326/121 |
| 6,008,687 | A | * | 12/1999 | Orita et al. | 327/313 |
| 6,028,573 | A | * | 2/2000 | Orita et al. | 345/60 |
| 6,094,192 | A | * | 7/2000 | Kobayashi et al. | 345/210 |
| 6,169,532 | B1 | * | 1/2001 | Sumi et al. | 345/98 |
| 6,271,783 | B1 | * | 8/2001 | Cairns et al. | 341/144 |
| RE37,552 | E | * | 2/2002 | Svensson et al. | 307/109 |
| 6,407,732 | B1 | * | 6/2002 | Stiens et al. | 345/100 |

FOREIGN PATENT DOCUMENTS

| | | |
|---|---|---|
| GB | 2 324 191 A | 10/1998 |
| WO | WO 96/06421 | 2/1996 |

OTHER PUBLICATIONS

Erhart, A. et al. 4.5L: Late-News Paper: Charge-Conservation Implementation in an Ultra-Low-Power AMLCD Column Driver Utilizing Pixel Inversion. In SID '97 Digest. 1997. pp. 23-26.

Ammer, J., M. Bolotski, P. Alvelda, T.F. Knight, Jr., "TP12. 5: A 160 ×120 Pixel Liquid-Crystal-on-Silicon Microdisplay with an Adiabatic DACM," In *1999 IEEE International Solid-States Circuits Conference Digest of Technical Papers,* pp. 212-213.

Ammer, J., M. Bolotski, P. Alvelda, T.F. Knight, Jr., "TP12. 5: A 160 ×120 Pixel Liquid-Crystal-on-Silicon Microdisplay with an Adiabatic DAC," *1999 ISSCC Slide Supplement,* pp. 184-185, 435-.

Athas, William C., "Energy-Recovery CMOS," Chapter 5 in J. Rabaey, M. Pedram (Eds.) *Low-Power Design Methodologies,* Kluwer Academic Press, 1996.

Athas, W.C. and L.J. Svensson, *Reversible Logic Issues in Adiabatic CMOS,* IEEE Workshop on Physics and Computation, Nov. 17-20, 1994 www.isi.edu/acmos Athas, W.C., J. Koller and L. Svensson, *An Energy-Efficient CMOS Line Driver Using Adiabatic Switching,* University of Southern California, Information Sciences Institute Technical Report ACMOS-TR-2, Aug. 15, 1993, pp. 1-16.

Athas, W.C., J. Koller and L. Svensson, "An Energy-Efficient CMOS Line Driver Using Adiabatic Switching," *IEEE,* 1994, pp. 196-199.

Athas, W.C., L. "J." Svensson and N. Tzartzanis, "A Resonant Signal Drive For Two-Phase, Almost-Non-Overlapping Clocks," *IEEE International Symposium on Circuits and Systems,* May 1996.

Athas, W.C., N. Tzartzanis, L. Svensson, L. Peterson, H. Li, X. Jiang, P. Wang, W-C. Liu, "AC-1: A Clock-Powered Microprocessor," *IEEE Intl. Symposium on Low-Power Electronics and Design,* Aug. 1997.

Athas, William C., Lars "J." Svensson, Jeffrey G. Koller, Nestoras Tzartzanis and Eric Ying-Chin Chou, "Low-Power Digital Systems Based on Adiabatic-Switching Principles," *IEEE Transactions on Very Large Scale Integration (VLSI) Systems,* vol. 2, Dec. 1994, pp. 398-407.

Burr et al., "Energy Considerations in Multichip-Module Based Multiprocessors," *IEEE International Conference on Computer Design* 1991, pp. 593-600.

Chandrakasan et al., "Low-Power CMOS Digital Design," *IEEE Journal of Solid-State Circuits,* Apr. 1992, vol. 27, No. 4, pp. 473-484.

Davis, Andrew W. "Flat Panel Display Drivers: 'Little Things' Changing The Image Quality Picture," *Advanced Imaging,* Oct. 1997, vol. 12, No. 10, pp. 10, 12, 62.

Dharmasena, Sanjaya and Lars Svensson, "Startup Energies in Energy-Recovery CMOS," in Proceedings of Physics and Computation '96, Boston, MA, Nov. 22-24, 1996.

Dickinson, Alex G. and John S. Denker, "Adiabatic Dynamic Logic," *IEEE, Custom Integrated Circuits Conference,* 1994, pp. 282-285.

Erhart, A. "P-10: Late Poster Paper: A High-Voltage High-Gray-Shade LCD Column Driver Utilizing a Standard 1.2-$\mu$ CMOS Process," *SID 94 Digest,* 1994,pp. 471-474.

Erhart, Alex. "Direct Drive Promises Reduced Power Consumption and Improved Image Quality for Notebook AMLCDs," *Information Display,* Dec. 1996, vol. 12, No. 12, pp. 24-27.

*Flat Panel Display Handbook, Technology Trends & Fundamentals,* First Edition, 1999, San Jose: Stanford Resources, 1999.

Fundaun, I., C. Reese and H.H. Soonpaa (Physics Department, University of North Dakota, Grand Forks), "Charging a capacitor," *American Journal of Physics,* vol. 60, No. 11, Nov. 1999, pp. 1047-1048.

Heinrich, F. (Laboratory of Solid State Physics, Swiss Federal institute of technology ETH), Entropy Change When Charging A Capacitor: A Demonstration Experiment,

*Americal Journal of Physics,* vol. 54, No. 8, Aug. 1986, pp. 742-744.
Jonscher, A.K. (Royal Holloway and Bedford New College, Univ. of London), "Charging and Discharging of Non-Ideal Capacitors," *IEEE Transactions on Electrical Insulation,* vol. EI-22, No. 4, Aug. 1987, pp. 357-359.
Kawahara, T., M. Horiguchi, Y. Kawajiri, T. Akiba, G. Kitsukawa, T. Kure, and M. Aoki. "A Charge Recycle Refresh for Gb-scale DRAMs in File Applications," *1993 Symposium on VLSI Circuits, Digest of Technical Papers,* May 19-21, 1993, pp. 41-42.
Koller, Jeffrey G. and William C. Athas, "Adiabatic Switching, Low Energy Computing, and the Physics of Storing and Erasing Information," IEEE Press 1993, pp. 267-270.
Lieberman, David, "EL Design Yields Brighter Display At Lower Power," *Electronic Engineering Times,* No. 1021, Aug. 1998, pp. 52-.
Maksimovic, Dragan, "A MOS Gate Drive With Resonant Transitions," IEEE Press, 1991, pp. 527-532.
Mateo, D. and A. Rubio, "Quasi-adiabatic ternary CMOS logic," *Electronics Letters,* vol. 32, No. 2, Jan. 18, 1996, pp. 99-101.
Mead et al., "Chapter 1, MOS Devices and Circuits," In *Introduction to VLSI Systems,* 1980, Addison-Wesley, pp. 1-37.
Morimura, Hiroki and Nobutaro Shibata, "A 1-V 1-Mb SRAM for Portable Equipment," *ISLPED, 1996 Monterey CA USA,* pp. 61-66.
Nordin et al., "A Systems Perspective on Digital Interconnection Technology," *IEEE Journal of Lightwave Technology,* Jun. 1992, vol. 10, No. 6, pp. 811-827.
*RCA Transistor Thyristor & Diode Manual,* RCA Corporation, Apr. 1971, Technical Series SC-15, 1971, pp. 179-183.
Schlig, E.S. and J.L. Sanford. "New Circuits for AMLCD Data Line Drivers," 1994.
Seitz et al., "Hot-Clock nMOS," *Proceedings of the 1985 Chapel Hill Conference on VLSI,* 1985, pp. 1-17.
Sekiguchi, Tomonori, Masashi Horiguchi, Takeshi Sakata, Yoshinobu Nakagome, Shigeki Ueda and Masakazu Aoki, "Low-Noise, High-Speed Data Transmission Using a Ringing-Canceling Output Buffer," *IEEE Journal of Solid-State Circuits,* vol. 30, No. 12, 1995, pp. 1569-1574.
Somasekhar, Dinesh, Yibin Ye and Kaushik Roy. "An Energy Recovery Static RAM Memory Core," in *IEEE Symposium on Low-Power Electronics,* 2d ed., 1995, pp. 62-63.
Svensson L. et al., *Adiabatic Charging Without Inductors,* IWLPD '94 Workshop Proceedings, 1994, pp. 159-163.
[Svensson, L.J.] LS. "LCD Driver Test Chip Evaluation," Oct. 21, 1996.
Svensson, L. "J.", W.C. Athas and R.S.-C. Wen, "A sub-$CV^2$ pad driver with 10 ns transition time," *ISLPED 1996 Monterey CA USA,* Aug. 1996, pp. 105-108.
Svensson, L. "J."and W.C. Athas, "Stepwise Charging Without Equations," USC/ISI, Feb. 25, 1997, pp. 1-4.
Tzartzanis, Nestor and William C. Athas, "Clock-Powered CMOS: A Hybrid Adiabatic Logic Style for Energy-Efficient Computing," *20th Anniversary Conference on Advanced Research in VLSI,* IEEE Computer Society Press, Mar. 1999.
Tzartzanis, Nestor and William C. Athas, "Energy Recovery for the Design of High-Speed, Low-Power Static RAMs," *International Symposium on Low-Power Electronics and Design,* Aug. 1996. Monterey CA USA, pp. 55-60.
Tzartzanis, Nestor, *Energy-Recovery Techniques for CMOS Microprocessor Design,* Ph.D. Dissertation, University of Southern California, Aug. 1998, 163 pp.
Weste et al., "Principles of CMOS VLSI Design, A Systems Perspective," Chapter 5 in *CMOS Circuit and Logic Design,* 2d Edition, 1993, Addison-Wesley, pp. 160-231. [need copy of document].
Ye, Yibin and Roy Kaushik, "Energy Recovery Circuits Using Reversible and Partially Reversible Logic," *IEEE Transactions on Circuits and Systems—I. Fundamental Theory,* vol. 43, No. 9, 1996, pp. 769-778.
Younis, Saed G. and Thomas F. Knight, Jr., "Non-Dissipative Rail Drivers for Adiabatic Circuits," *IEEE,* Sep. 1995, pp. 404-414.
Yuan, Jiren (Linkoping University), "Low Power and Low Area or High Throughput Single-Ended Bus and I/O Protocols," *Proceedings of 1997 IEEE International Symposium on Circuits and Systems: Circuits and Systems in the InformationAge, ISCAS '97,* Jun. 9-12, 1997, Hong Kong, pp. 1932-1935.

* cited by examiner

POWER-EFFICIENT, PULSED DRIVING OF CAPACITIVE LOADS TO CONTROLLABLE VOLTAGE LEVELS

CROSS-REFERENCE TO RELATED APPLICATIONS

This application claims the benefit of U.S. Provisional Applications Nos. 60/099,120, filed Sep. 3, 1998, and 60/143,665, filed Jul. 14, 1999, the contents of which are incorporated herein by reference.

GOVERNMENT LICENSE RIGHTS

The U.S. Government has a paid-up license in this invention and the right in limited circumstances to require the patent owner to license others on reasonable terms as provided for by the terms of Grant No. DAAL01-95-K3528, awarded by DARPA.

BACKGROUND OF INVENTION

1. Field of the Invention

This invention relates to driving capacitive loads and, more particularly, to driving liquid crystal displays ("LCDs").

2. Description of Related Art

LCDs are in widespread use today, and their popularity is expected to increase. These devices operate by controlling the amount of light that is passed or reflected by a set of liquid crystal (LC) elements arranged in rows and columns in the display. Each LC element comprises a pair of plates surrounding liquid crystal material. The amount of light that is passed or reflected by an LC element is controlled by the voltage that is delivered to the plates of that element.

To maintain the amount of light passed or reflected by the LC element at a constant level, the voltage across the element must usually be reversed in polarity periodically. As a result, an AC signal is typically used to drive the element, the magnitude of the signal determining the amount of light that is passed or reflected.

A typical LCD has hundreds of thousands of LC elements arranged in hundreds of rows and columns. To reduce the amount of circuitry that is needed to drive each LC element, all LC elements in the same row typically communicate through a single row line, while all elements in the same column typically communicate through a single column line. Each LC element is thus uniquely defined by the row and column line that intersect at its location. The voltage across each element is regulated by controlling the amount of charge that is delivered to it through its coordinating row or column line.

The picture displayed by an LCD is typically painted by sequentially scanning each line of the display, somewhat like the way a picture is painted in a television set. For example, the first row line might be activated, followed by the delivery of the desired signal to the first column line, thus establishing the desired voltage across the first element in the first row. While the first row line is still activated, the desired signal would then be delivered to the second column line, thus establishing the desired voltage across the second element in the first row. This process would typically continue until all of the elements in the first row are set to their desired levels. Alternatively, the desired voltage across all of the elements in a row can be applied at the same time.

The second row line would then be activated, followed by the sequential or simultaneous charging of each LC element in the second row. This process would continue until the voltages across all of the LC elements in the display are set to their desired levels. This entire cycle would then repeat itself a short time later, but with the voltages being of opposite polarity, to provide the refreshment needed for each LC element.

Electronic switches are often used to controllably connect and disconnect each element to its associated column line. The control input to these switches is typically connected to the row line at which each switch resides. These switches, however, also often have intrinsic capacitance.

Although only one LC element in a column is typically charged at a time, the switches that are associated with the elements that are not being driven typically also impose a significant amount of capacitance on the column line through which the voltage is being delivered to the single element that is being driven. Because there are typically hundreds of rows of LC elements that are connected to the column line through which the voltage is being delivered to the single element, the combined effect of the capacitance imposed by these inactive switches often imposes hundreds of times the amount of capacitance that is exhibited by the single element that is being driven.

There is also often significant intrinsic capacitance between the lines that control the LC elements and the backplane of the display.

This very large amount of combined capacitance on the column lines often causes large amounts of energy to be dissipated during the use of the LCD. As the voltage on each LC element is being reversed in polarity, the voltage on the much-larger capacitance that is imposed on the line must also usually be changed. This typically requires a large amount of current. In turn, the passage of this current through the resistances of the switching devices and other components that are necessary to drive the LCD causes large amounts of energy to be dissipated.

As a result, hundreds of times the amount of energy that is actually needed to drive each LC element is often wasted because of the large capacitance that is associated with the lines through which the voltages to the elements are delivered.

This large wasted energy is particularly problematic in applications in which energy dissipation needs to be minimized, such as in portable laptop computers. As is well known, the time a single charged battery can run a laptop is a very important specification. The significance of the energy being wasted in driving the lines of an LCD is becoming even more important in view of new technologies that are reducing the energy needed in other areas of the laptop computer. This includes new technologies that are eliminating the need for backlighting of displays and new technologies that are reducing the energy consumed by the microprocessor circuitry and associated storage devices.

SUMMARY OF INVENTION

One object of the invention is to minimize these as well as other problems in the prior art.

Another object of the invention is to provide a system and method for driving capacitive loads to controllable voltage levels in a power-efficient manner.

A still further object of the invention is to provide a system and method for recovering energy that is stored in a capacitive load.

A still further object of the invention is to recover energy that is stored in capacitances associated with the driving lines of an LCD, other than in the LC elements.

A still further object of the invention is to reduce the amount of energy that is needed to drive an LCD.

These as well as still further objects, features and benefits of the invention are achieved through the use of a system and method that drives capacitive loads to controllable voltage levels in an energy-efficient manner.

In one embodiment of the invention, one of the LC elements is charged by delivering a voltage on the line that is associated with the element. Energy is then recovered from the other capacitances that are associated with the line while the voltage across the charged element is maintained. This process may then be repeated until all of the other elements in the display are driven.

In one embodiment of the invention, each LC element is connected to its associated column line through an electronic switch that is controlled by the row line associated with the element.

In one embodiment of the invention, adiabatic charging is used to drive the LC elements. This can utilize various signals, including a ramp signal, a staircase signal, or a half-wave sine pulse.

In one embodiment of the invention, adiabatic discharging is used to recover the energy from the driving line. This can similarly use a variety of signals, including a ramp signal, a staircase signal or a half-wave sine pulse.

The invention also includes a circuit for reducing the energy consumed by a display. In one embodiment, the circuit advantageously includes a voltage connection system connected to the driving line for controllably causing the driving line to connect to a voltage source; a recovery connection system for connecting to a driving line for controllably causing the driving line to connect to a reservoir; and a control system for causing the voltage connection system to connect the driving line to a voltage source during a first time period and for causing the recovery connection system to connect the driving line to the reservoir during a second time period. In one embodiment, the display is an LCD and voltages on the LC elements are not materially changed during the second time period.

In a still further embodiment, the source and the reservoir constitute a single supply that generates a signal conducive to adiabatic charging and discharging. The voltage connection system includes a first electronic switching system connected between the supply and the driving line. The recovery system includes a second electronic switching system connected between the supply and the driving line. The control system controls the first and second electronic switching systems. The adiabatic charging and discharging may use a variety of signals, including a ramp signal, a staircase signal, or a half-wave sine pulse.

In a still further embodiment of the invention, the first electronic switching system includes a transmission gate connected in series with a MOSFET. The second electronic switching system may also advantageously include a MOSFET.

In a still further embodiment of the invention, the second time period begins a predetermined amount of time after the first time period. In an alternate embodiment, the second time period begins when the voltage of the supply is approximately equal to the voltage of the driving line. A comparator circuit may advantageously be connected to the supply and the driving line for determining when the voltage of the supply is substantially equal to the voltage of the driving line.

In a still further embodiment, the display is an LCD, an electroluminescence display or a field-emission display.

In a still further embodiment of the invention, the circuitry and process is adapted to work in conjunction with a serial video signal, such as the serial video signal delivered at a VGA port.

Although having thus-far been described as useful for displays, the invention is also useful in a broad array of systems in which a capacitive load or capacitive loads must be driven to a controllable voltage level or voltage levels.

These as well as still further features, objects and benefits of the invention will now become clear upon consideration of the following detailed descriptions of the preferred embodiments, taken in conjunction with the drawings that are attached.

DETAILED DESCRIPTION OF PREFERRED EMBODIMENTS

Figure 1:
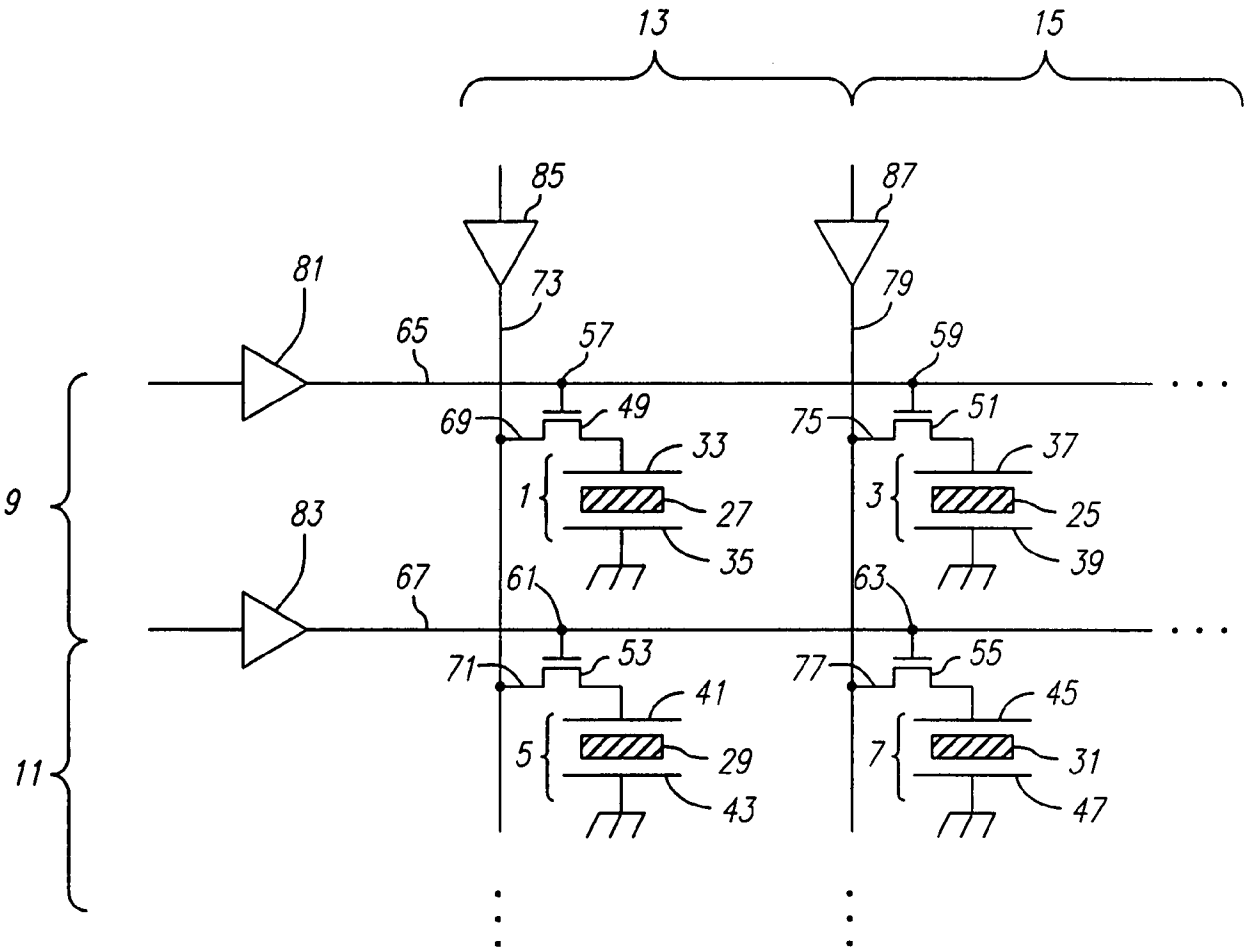
FIG. 1 PRIOR ART
FIG. 1 illustrates a portion of a typical prior art LCD.

FIG. 1 illustrates a portion of a typical prior art LCD.

As shown in FIG. 1, the LCD includes a plurality of LC elements arranged in rows and columns, such as LC elements 1, 3, 5 and 7 arranged in rows 9 and 11 and columns 13 and 15.

As is well known, each LC element includes liquid crystal material, such as liquid crystal materials 25, 27, 29 and 31, sandwiched between a set of plates, such as plates 33 and 35, plates 37 and 39, plates 41 and 43, and plates 45 and 47, respectfully. The amount of light which is permitted to pass through each element is directly related to the voltage that is placed across the plates surrounding each liquid crystal material.

As is also well known, there are many types of LCDs, including active-matrix, thin-film-transistor ("AMTFT") panel types and passive-matrix, super-twisted nematic ("PMSTN") panel types. Some LCDs, moreover, include backlighting, while others do not.

There are also a broad variety of techniques used to drive each LC element. As indicated in the Description of Related Art above, the voltage on each element is usually periodically reversed in order to maintain the same level of light transmittance. In some embodiments, one plate of the element is connected to a constant voltage, such as ground, and the other plate is driven both positively and negatively. In other embodiments, one plate of each element is connected to a square-wave signal having the same amplitude as the maximum data line swing and either the frequency of the frame or the line. This latter approach reduces the amount of swing needed on the data line, but increases the amount of flicker. In a still further embodiment, one plate is connected to a voltage that is half of the maximum driving voltage.

The invention is applicable to all of these embodiments, as well as to others. For illustration purposes, however, FIG. 1 illustrates a portion of a typical active-matrix display with one connection of each LC element 1, 3, 5 and 7 going to ground.

In this embodiment, the other connection of each LC element is connected to a switch. Thus, one connection of LC element 1 is connected to a switch 49, one connection of LC element 3 is connected to a switch 51, one connection of LC element 5 is connected to a switch 53, and one connection of LC element 7 is connected to a switch 55.

In this embodiment, the control lines of each switch are connected to a row line, such as a control line 57 of switch 49 and a control line 59 of switch 51 being connected to a row line 65, and a control line 61 of switch 53 and a control line 63 of switch 55 being connected to a row line 67. Similarly, the input to each switch is typically connected to a column line, such as an input 69 to the switch 49 and an input 71 to the switch 53 to a column line 73 and an input 75 to the switch 51 and an input 77 to the switch 55 to a column line 79.

Each row line may be actuated sequentially by the delivery of a signal on that row line to its driver, such as a driver 81 for the row line 65 and a driver 83 for the row line 67. While a particular row line is actuated, the voltage that is needed to be placed across each LC element connected to that row line is typically delivered on the column line that coordinates with that LC element. This process may continue sequentially from one column line to the next, until all of the LC elements in a row are driven to their desired states, or simultaneously to all of the LC elements in a row. Drivers, such as a driver 85 for the column line 73 and a driver 87 for the column line 79, are typically used to facilitate this process. Typically, only one row line is actuated at a time.

Only a portion of a typical LCD is illustrated in FIG. 1. An actual LCD would usually have hundreds of rows and hundreds of columns of LC elements with all of the associated lines and components that have been described above being duplicated to match.

As also explained in the Description of Related Art above, there are other large capacitances that typically must be driven by each row and column line, while each LC element is being driven. This includes the capacitance between the driving line and the backplane of the LCD, as well as the capacitance that is intrinsic to each of the other switches that are attached to the driving line, even in their off state. The sources of capacitance that are imposed on a driving line, other than the capacitance imposed by the LC element that is being driven, is referred to in this application as "other capacitances." The amount of this other capacitance is typically hundreds of times the amount of the capacitance intrinsic to each LC element. Having to constantly move these other large capacitances through large voltage swings usually wastes large amounts of energy in the resistance of the switching system that is used to drive these displays, as well as in the resistance that is intrinsic to the source or sources of supply (also not shown) that drive these lines. This wasted energy is particularly high in the column lines which are usually going through large voltage swings on a very frequent basis.

Figure 2:
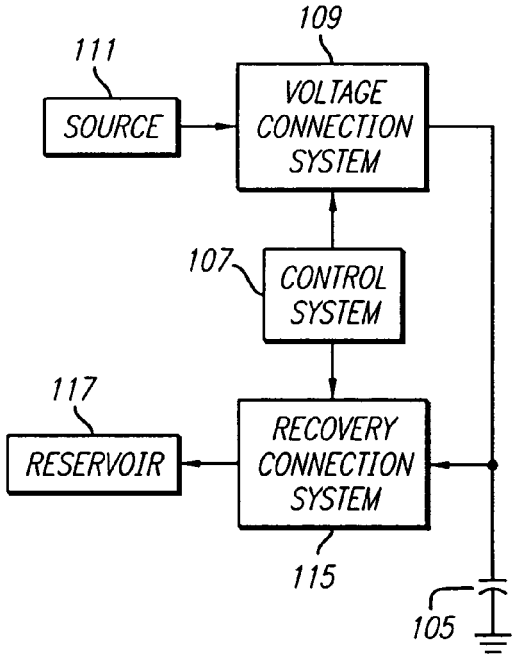
FIG. 2 is a block diagram of one embodiment of the invention shown connected to the combined capacitance that is imposed on a single line in a display.
Figure 3:
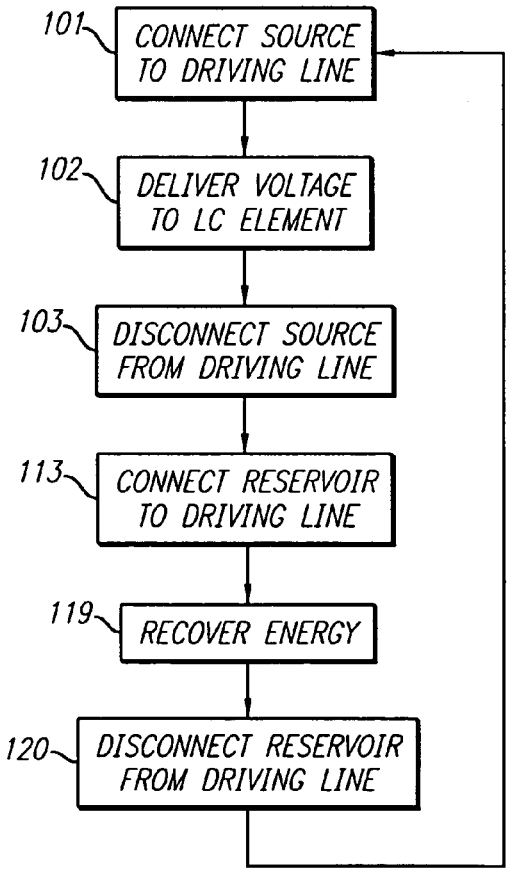
FIG. 3 is a flow diagram of the process employed in the embodiment of the invention shown in FIG. 2.

FIG. 2 is a block diagram of one embodiment of the invention shown connected to the combined capacitance that exits on a single line in a display. FIG. 3 is a flow diagram of the process employed in the embodiment of the invention shown in FIG. 2. The operation of the embodiment shown in FIG. 2 will now be explained in conjunction with the diagram of that process shown in FIG. 3 and the prior art LCD illustrated in FIG. 1.

The first step is for a particular row to be activated, such as, for example, by activating the row line 65 shown in FIG. 1.

Although switches, such as switches 49, 51, 53 and 55, shown in FIG. 1, act as control mechanisms for the rows of LC elements that are activated, it is to be understood that the invention is also applicable to displays in which the row lines are directly connected to the LC elements without any intervening switches, such as passive displays. In this instance, the other connection to the LC elements might be directly connected to their associated column lines. For purposes of clarity, references in this application to "activating" a line are intended to apply to both types of situations, as well as to any other technique that is used to drive an LC element.

After a row is activated, the source is then connected to the column line that is associated with the LC element to be driven, such as to the column line 73 that is associated with LC element 1 in FIG. 1. This is reflected by a Connect Source to Driving Line block 101 in FIG. 3. The necessary voltage is then applied to the LC element in that row through the column line that is associated with that element. This step is reflected in a Deliver Voltage to LC Element block 102.

As explained above, there are capacitances associated with column lines, other than the capacitance imposed by the LC element being driven. The total capacitance imposed on a particular column line at any one time is illustrated in FIG. 2 as a capacitor 105. Although FIG. 2 illustrates one terminal of this total capacitance 105 as being connected to ground for simplicity, it is to be understood that, in practice, each of the contributing capacitive components may, in fact, be connected to different potentials.

To effectuate the driving of an LC element, such as the LC element 1 in FIG. 1, a control system 107 activates a voltage connection system 109 to connect a voltage source 111 to the column line associated with the LC element, such as the line 73 in FIG. 1. This causes the voltage source 111 to be connected to the entire capacitance that is imposed on the charging line, this entire capacitance being illustrated in FIG. 2 as the capacitor 105. The other LC elements in the same row may then be driven sequentially or simultaneously in the same manner.

After the LC element is driven to a desired state, its row line is deactivated. The circuit path for driving the LC element is broken and the voltage on the LC element remains to perpetuate the level of light conductivity that has been established by that voltage.

The control system 107 then signals the voltage connection system 109 to disconnect the source 111 from the column line, as reflected by a Disconnect Source From Driving Line block 103. The control system 107 then causes a recovery connection system 115 to connect the column line to a reservoir 117, as reflected by a Connect Reservoir to Driving Line block 113. The energy that is stored in the capacitances associated with the column line (again, shown as the capacitor 105) is then recovered and stored in the reservoir 117. This is reflected in a Recover Energy block 119 in FIG. 3. Finally, the reservoir is disconnected from the column line, as reflected by a Disconnect Reservoir from Driving Line block 119.

Significantly, the voltage that was placed on the LC element is not affected during the recovery phase because the circuit to the plates of the LC element is broken during this phase, as explained above, while the energy is being recovered from the other capacitances.

This driving and recovery cycle can then be repeated in the course of driving the other LC elements in the display, as well as during subsequent frames when the light transmittance on the already driven element is either maintained through the application of an equal but opposite voltage or is changed through the application of a voltage having a different voltage.

Both the voltage connection system 109 and the recovery connection system 115 may include electronic switches, such as transistors (e.g., FETs or MOSFETs) and gates, that are controlled by the control system 107. The control system 107, in turn, may include electronic circuitry, such as transistors (e.g., FETs or MOSFETs) and gates, that generate the necessary control signals in accordance with well-known control signal techniques.

Figure 4:
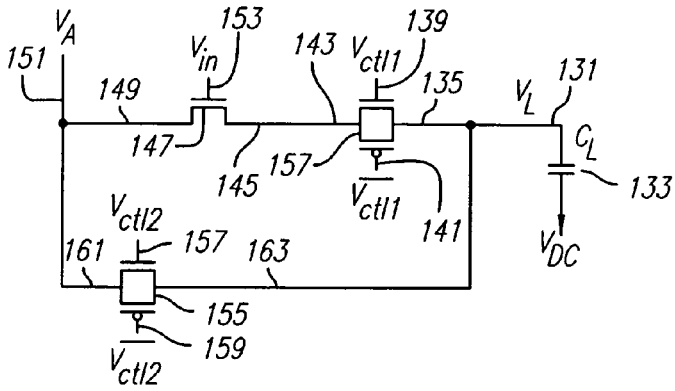
FIG. 4 is a schematic of one embodiment of a circuit that can advantageously be used to implement a portion of the invention.

FIG. 4 is a schematic of one embodiment of a circuit that can advantageously be used to implement a portion of the invention.

The total capacitance imposed on a particular line 131 of an LCD, such as the column line 73 shown in FIG. 1, is modeled in FIG. 4 as a capacitor 133. As explained above, at this time, the total capacitance includes the capacitance imposed by the particular LC element that is connected to the line that is currently being driven, as well as the far more substantial capacitance between the particular line and the backplane and the capacitances associated with the other inactive switches that are connected to the same line. Although FIG. 4 illustrates one terminal of this total capacitance 133 as being connected to $V_{DC}$ for simplicity, it is to be understood that, in practice, each of the contributing capacitive components may, in fact, be connected to different potentials.

The line 131 is connected to a terminal 135 of a transmission gate 137. The transmission gate 137 also has a control input 139, an inverting control input 141, and another terminal 143. As is well known, a transmission gate is a semiconductor device, typically including an N-channel semiconductor device connected in parallel to a P-channel semiconductor device, that electrically connects its two terminals upon receiving a control signal at its control signal input and an inverting control signal at its inverting control signal input, without any appreciable voltage drop.

The terminal 143, in turn, is connected to a terminal 145 of an electronic switching device 147, such as a MOSFET. Another terminal 149 of the switching device 147 is connected to a voltage source $V_A$ through a connection 151. The switching device 147 also has a control input terminal 153.

The line 131 is also connected to a terminal 163 of another transmission gate 155 which also has a control input 157, an inverting control input 159, and another terminal 161. The terminal 161 is also connected to the same voltage source $V_A$ through the connection 151. As will soon be seen, the voltage source $V_A$ simultaneously acts as a reservoir.

Figure 5:
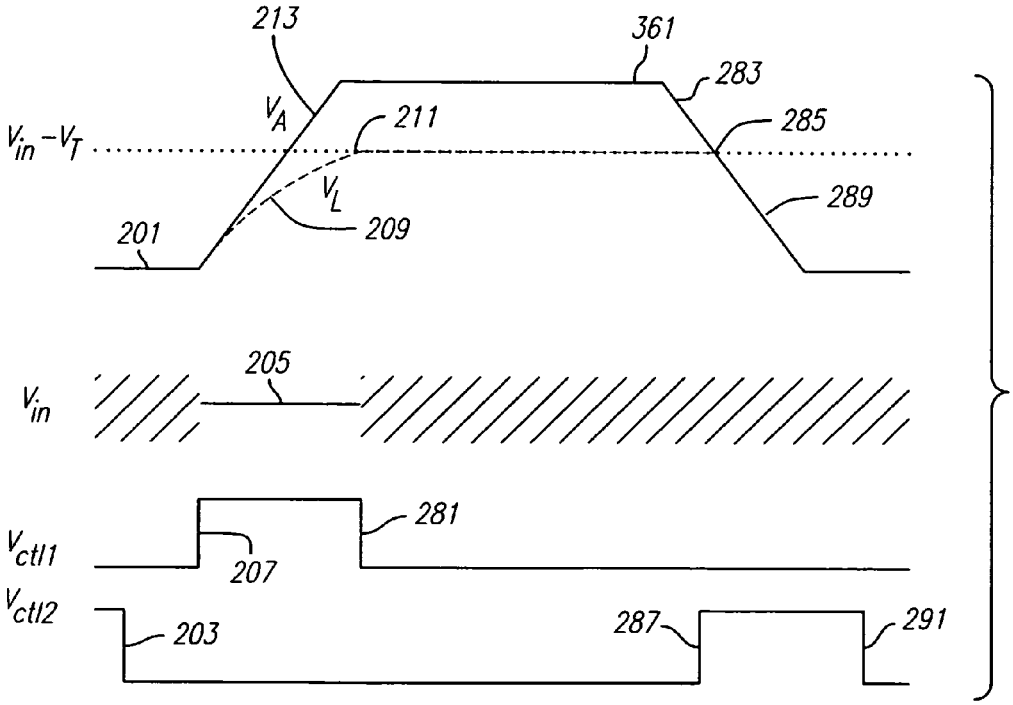
FIG. 5 is a diagram illustrating various signals present during the operation of the circuit shown in FIG. 4.

FIG. 5 is a diagram illustrating various signals present during the operation of the circuit shown in FIG. 4. The operation of the circuit shown in FIG. 4, as well as the signals that the circuit processes and generates, are best understood by consideration of FIGS. 4 and 5 together.

In one embodiment, the voltage source $V_A$ is initially at zero, as shown in FIG. 5 by a line segment 201. Before the driving process begins, the transmission gate 155 is turned off by having its control input 157 switched off, as reflected by a line segment 203 shown in FIG. 5. Although not shown, it is to be understood that the inverse of the signal delivered to the control input 157 is always delivered to the inverting control input 159. This causes the circuit between terminals 161 and 163 to be open.

At about the time the voltage source $V_A$ is about to rise, two things happen. First, a signal equivalent to the voltage that is desired to be placed across the LCD element that is being driven (plus the anticipated gate to source threshold voltage drop $V_T$ in the switching device 147) is delivered to the control input terminal 153 of the switch, as shown by a line segment 205 in FIG. 5. Second, transmission gate 137 is activated by the delivery of an activation signal to its control input 139 and an inverse activation signal to its inverting control input 141. The activation signal is shown by a line segment 207 in FIG. 5. This causes the transmission gate 137 to connect its terminal 143 to the capacitances represented by capacitor 133.

At this early stage of the driving process, the desired level of voltage at the control input terminal 153 to the switching device 147 is greater than the output of the switching device 147 at its terminal 145. As a result, the switching device 147 is activated. In turn, the voltage source $V_A$ at the connection 151 is connected to the line 131 and in turn, to the plate of the LC element to be driven.

The voltage source $V_A$ now rises from its initial value, as shown by line segment 213. This causes charge to be gradually delivered to the LC element. As the voltage across the LC element builds up, it approaches the voltage $V_{in}$ at the control input terminal 153 to the switching device 147, less the gate to source threshold voltage $V_T$ across switch 147, as shown by a line segment 209. As it does, the resistance of the switching device 147 increases until the switching device 147 cuts off. This occurs at approximately point 211 shown in FIG. 5. In effect, the switching device 147 acts as a voltage regulator to ensure that the voltage across the LC element is charged to the desired value applied at its control input terminal 153, less the gate to source drop $V_T$ across the switching device 147, without placing a large load on $V_{in}$, thus ensuring that its unloaded value is preserved.

It will be noted that, in this embodiment, the voltage source $V_A$ is preferably a time-varying supply voltage. It also preferably does not rapidly rise from zero to its maximum value, such as would happen in the case of a fast-rising square-wave signal. Instead, $V_A$, rises more slowly, such as the ramp signal shown in FIG. 5 by a segment 213.

The use of a time-varying supply voltage reduces energy dissipation during the driving portion of the cycle. Without a time-varying supply voltage, there is a large voltage difference between the voltage source and the voltage across the capacitive load when charging is initiated. In turn, this causes substantial energy losses in the elements in the driving system that have resistance, such as in the switching devices and in the internal impedance of the voltage source $V_A$.

A time-varying supply voltage, on the other hand, such as the ramp signal shown by the segment 213 in FIG. 5, reduces this lost energy by reducing the instantaneous voltage drop across the resistive components of the voltage supply and switching drive system. Preferably, the supply voltage rises just slightly faster than the voltage across the capacitive load, thus minimizing the voltage differential at all times. The use of a time-varying supply voltage in this manner is referred to by the inventors as adiabatic charging.

A ramp signal, such as the segment 213 in FIG. 5, is only one of a variety of wave shapes that can be used to effectuate adiabatic charging.

Figure 6:
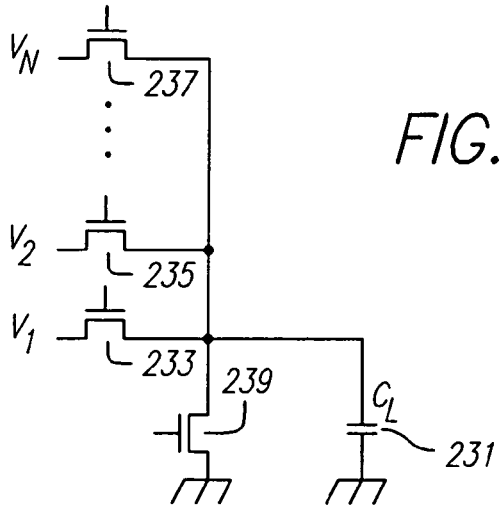
FIG. 6 is a schematic of a circuit that produces a signal useful in adiabatic charging and/or discharging.

FIG. 6 is a schematic of a circuit that produces another form of a signal useful in adiabatic charging, i.e., a staircase signal. As shown in FIG. 6, the combined capacitive load is illustrated as a capacitor 231. The ultimate voltage desired across the capacitor is $V_N$. A series of lower voltage steps are illustrated as $V_1$, $V_2$, etc.

When it is desired to drive the capacitive load, i.e., the capacitor 231, a switch 233 is closed, causing the first level of the voltage $V_1$ to be applied. Next, the switch 233 is opened and a switch 235 is closed, causing the next level of voltage $V_2$ to be applied. This process continues until the final voltage level $V_N$ is applied through the closure of a switch 237. A switch 239 is also provided to discharge the capacitive load 231 at the appropriate time.

Figure 7:
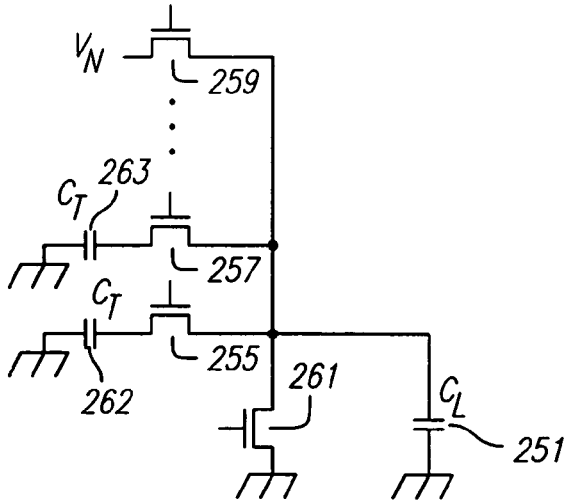
FIG. 7 is a schematic of a circuit that uses a set of capacitors to furnish the voltage levels necessary for generating a staircase signal useful in adiabatic charging and/or discharging.

FIG. 7 is a schematic of a circuit that uses a set of capacitors to furnish the voltage levels necessary for generating a staircase signal used in adiabatic charging. As with FIG. 6, the combined capacitive load to be charged is illustrated as a capacitor 251 connected to a series of stepping switches 255, 257 and ultimately 259, as well as a discharge switch 261. In this case, however, the voltages necessary for each step before the desired voltage $V_N$ is reached are supplied by a series of capacitors, including capacitors 262 and 263. Using appropriate circuitry and timing, these capacitors are charged to the appropriate step levels and, thereafter, function as the needed voltage sources for their respective steps.

More details concerning the use of a staircase signal for adiabatic charging can be found in U.S. Pat. No. 5,473,526, the contents of which are incorporated herein by reference.

Figure 8:
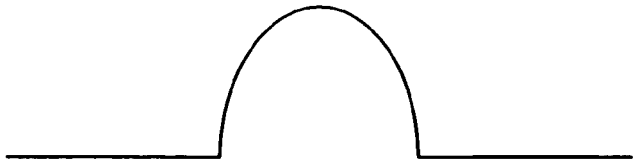
FIG. 8 illustrates a half-wave sine pulse that is useful in adiabatic charging and/or discharging.

A still further example of a signal useful in adiabatic charging is shown in FIG. 8. FIG. 8 illustrates a half-wave sine pulse. Circuitry that may advantageously be used to generate such a half-wave sine pulse is described in U.S. Pat. No. 5,559,478, the contents of which are also incorporated herein by reference.

As explained above, the vast majority of the current that must be delivered into a line in an LCD is needed to charge large capacitances other than the capacitance associated with the LC element that is being driven. This cause substantial energy to be wasted.

The use of adiabatic charging substantially reduces the energy losses associated with having to drive such a large capacitive load, as explained above.

There are also energy losses as the capacitances are discharged during the next cycle when the voltage on the LC element is reversed. The systems shown and described in FIGS. 2 and 3, and the specific embodiment of these systems shown and described in FIGS. 4 and 5, also substantially reduce this problem.

After the voltage across the LC element that is being driven reaches its desired level, as shown by the point 211 in FIG. 5, the transmission gate 137 is turned off by the removal of the activation signal from its control input 139, as shown by a line segment 281 in FIG. 5. (Again, the complementary signal is delivered to the inverting control input 141.) This disconnects the capacitive load 133 from the connection 151 that goes to the voltage supply.

The row line that is activating the particular LC element that has just been charged is then deactivated. This disconnects the LC element from the driving line and leaves the voltage across the LC element (and thus the level of light transmittance of the LC element) intact. However, the energy contained in the other large capacitances that are associated with the driving line remains.

Next, the supply signal $V_A$ starts to ramp back down, as shown by a line segment 283 in FIG. 5. At approximately the point when the supply voltage reaches the voltage on the column, as shown by a point 285, the transmission gate 155 is closed by the delivery of a control signal at its control input 157, as illustrated by a rising pulse 287. (Although not shown, a complementary segment is delivered to the inverting control input 159.) This causes the line containing the large parasitic charge to be connected to the source $V_A$ through the connection 151. As the voltage source $V_A$ continues to fall, as reflected by a line segment 289, energy stored in the parasitic capacitance is gradually returned to the voltage source $V_A$ through the connection 151 during this recovery phase.

After substantially all of the energy has been recovered, the transmission gate 155 is opened by the removal of an activation signal from its control input 157, as shown by a line segment 291, and by the delivery of a complementary signal to its inverting control input 159. The system is then ready for the entire driving and recovery process to be repeated.

It should again be noted that, in this embodiment, the voltage source $V_A$ does not rapidly fall from its maximum amplitude, such as would occur in the case of a fast-falling square-wave signal. A time-varying supply voltage is preferably used during the discharge phase, such as the ramp signal that is shown in FIG. 5 by the line segment 289. As in the driving phase, the use of a time-varying supply voltage during the recovery phase—adiabatic discharging—prevents high voltages from appearing across the resistive devices in the driving system, such as the switches and internal impedance of the voltage source, thereby reducing energy losses during the recovery phase. Without adiabatic discharging, much of the stored energy would be dissipated.

As with adiabatic charging, the shape of the signal used in adiabatic discharging can take a variety of forms, in addition to the ramp signal that is illustrated by the line segment 289 in FIG. 5. Thus, for example, it could take the same staircase form that may be advantageously produced by the circuitry shown in FIGS. 6 and 7, as well as the circuitry shown in U.S. Pat. No. 5,473,526. It may also take the form of a half-wave sine pulse, such as the half-wave sine pulse shown in FIG. 8. Numerous other wave shapes are also embraced. Again, the key feature is that the voltage supply provide a time-varying signal and, preferably, one that does not fall rapidly, as does a typical square wave signal.

Figure 9:
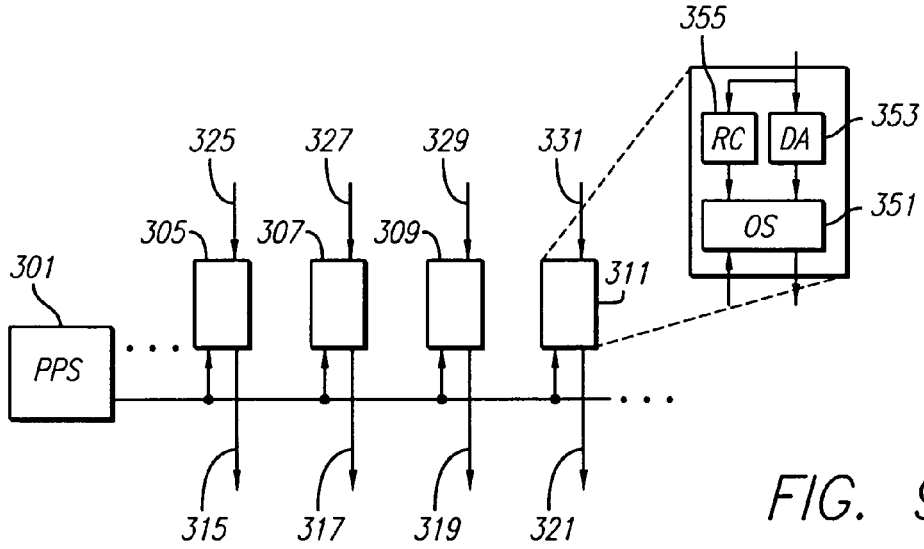
FIG. 9 is a block diagram of a collection of drivers that may advantageously be used for an LCD, incorporating concepts of the invention.

FIG. 9 is a block diagram of a collection of drivers that may advantageously be used for an LCD panel, incorporating the concepts of the invention.

As shown in FIG. 9, a pulsed-power supply 301 generates the charging and discharging signal. As previously discussed, both the charging and discharging signal are preferably of the type that cause adiabatic charging and discharging.

The signal generated by the pulsed-power supply 301 is delivered to drivers for each line, such as line drivers 305, 307, 309 and 311. The output of each driver is connected to the line which it drives. Thus, the output of the line driver 305 is connected to a line 315; the output of the line driver 307 is connected to a line 317; the output of the line driver 309 is connected to a line 319; and the output of line driver 311 is connected to a line 321.

Similarly, the input of each driver is connected to the signal that represents the desired voltage to be placed across the LC element that is being driven. Thus, the line driver 305 is connected to the desired signal at an input 325; the line driver 307 is connected to its desired signal at an input 327; the line driver 309 is connected to its desired signal at an input 329; and line driver 311 is connected to its desired signal at an input 331.

As should now be readily apparent, the configuration shown in FIG. 9 allows for the use of a single power supply to provide the needed voltage for all of the drivers. To accomplish this, all of the drivers are configured to deliver their voltage at the same time, thus causing all of the LC elements in a single activated row to be driven at the same time.

On a more specific level, each driver includes an output stage 351, such as the circuit shown in FIG. 4; a digital-to-analog converter 353 for converting a digital signal representing the desired voltage level into its analog equivalent; and a recovery controller 355 for controlling the point in time when the output stage is directed to recover energy from the other capacitances imposed on the line by returning it to the power supply 301.

The type of digital-to-analog converter that is used is not crucial. The load imposed on the converter is small and the allowable conversion time is relatively large (being set by the line interval). The designer therefore has considerable freedom to choose a suitable structure. A sample-ramp digital-to-analog converter that may advantageously be used is described in T. Gielow, R. Holly and D. Lanzinger, Monolithic Driver Chips for Matrix Gray-Shaded TFEL Displays, SID 81 Digest, 1981, pp. 24–25, the contents of which are incorporated herein by reference.

If a switch is used, such as the electronic switching device 147 (FIG. 4), it is important to provide compensation to insure that voltage across the LC element is driven to its correct level, not withstanding the threshold voltage of the electronic switching device 147. This can be done in the hardware and/or software that generates the desired digital level signal. It can also be done in the digital-to-analog converter circuit. A simple compensation circuit for this purpose is described in E. S. Schlig and J. L. Sanford, New Circuits for AMLCD Data Line Drivers, International Display Research Conference, Monterey, Calif., Oct. 10–13, 1994, pp. 386–89, the contents of which are incorporated herein by reference.

There are numerous ways to implement the recovery controller 355. One approach is to use an open-loop timing scheme to cause the transmission gate 155 (FIG. 4) to close at the moment when the supply voltage is expected to be approximately equal to the voltage across the capacitive load. This open-loop process can key the necessary timing to a wide variety of events, one of which, in the case of the ramp shown in FIG. 5, might be the point in time 361 when the downward ramp begins. In this instance, the recovery controller would detect the beginning of the declining ramp (or be provided with this information from the voltage source) and would then issue a signal to turn off the transmission gate 155 at a predetermined time later. The pre-determined amount of time, of course, would depend upon the slope of the ramp and the level of the voltage on the line.

Another approach is to compare the voltage of the downward ramp with the voltage across the capacitive load and to activate the transmission gate 155 when these voltages are approximately equal.

Figure 10:
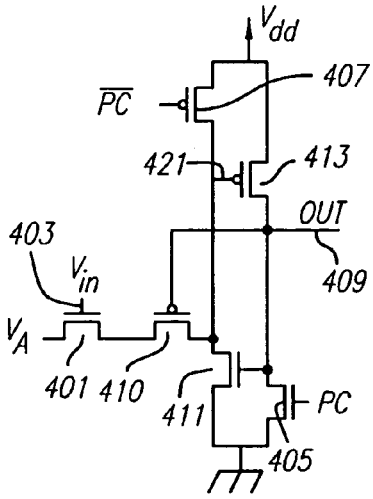
FIG. 10 is a schematic of a comparator circuit that generates a signal that can be used to activate the energy recovery phase of the system.

FIG. 10 is a schematic of a comparator circuit that generates a signal used to activate the energy recovery phase of the system. As shown in FIG. 10, the voltage supply $V_A$ is delivered to a switch 401. The voltage $V_{in}$ can be delivered to a control input 403 of the switch 401.

Before entry into the recovery phase, the circuit is reset by pulsing the pre-charge input PC to a gate 405 high and a complementary input to a gate 407 low. This causes the control output 409 of the circuit to be low and, in turn, to turn on a gate 410. After this precharge pulse, all switches in the device are off, including switches 411 and 413. However, switch 410 is on.

When $V_A$ falls below $V_{in}$ minus the threshold voltage $V_T$ of the switch 401, the switch 401 turns on. Since the switch 410 is already on, charge from a gate 421 of the switch 413 begins to drain. When the potential of the gate 421 falls below the supply voltage, $V_{dd}$, less the threshold voltage $V_T$ of the switch 413, the switch 413 turns on and pulls up the control output 409. When the control output 409 reaches $V_T$, the switch 411 turns on, pulling down the gate 421 further, thereby speeding up the transition of the control output 409 due to positive feedback.

As the control output 409 goes high, the switch 410 shuts off to isolate $V_A$ from the switch 411 which would otherwise clamp it to ground. $V_A$ is then brought high before the next cycle starts with a new pre-charge pulse to PC.

It should now be apparent that the control output 409 transitions when $V_A$ falls below $V_{in}$- $V_T$, not when $V_A$ falls below $V_{in}$. In other words, the comparator has an offset voltage of $V_T$. This is not a drawback when used with the output stage shown in FIG. 4. Control input 403 can be connected to control input terminal 153. The control output 409 then transitions when $V_{in}$ equals $V_A$, as desired.

As illustrated in FIG. 5, the desired voltage $V_{in}$ may change from its original value before discharging commences at point 285. This facilitates pipelining. However, the circuit shown in FIG. 10 requires the value of $V_{in}$ to be known during the recovery phase.

One approach for handling these divergent needs is to sample the value of $V_{in}$ at the input of the comparator at the point in time when the line becomes fully charged, i.e., at the point 211 in FIG. 5.

Figure 11:
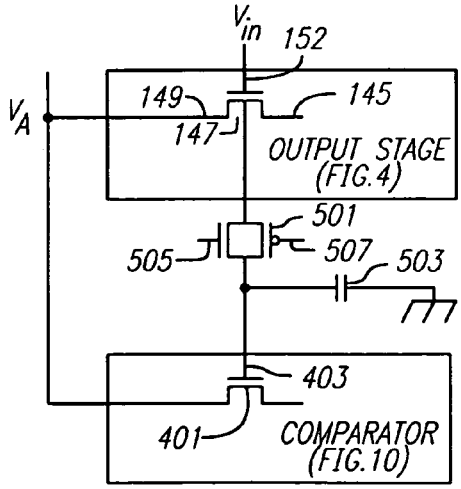
FIG. 11 illustrates portions of a circuit that can advantageously be used to sample the desired input voltage to effectuate pipelining.

FIG. 11 illustrates a circuit that can advantageously be used to sample the desired input voltage to effectuate pipelining. As shown in FIG. 11, $V_{in}$ is connected to the input of electronic switching device 147, exactly as it is shown in FIG. 4. Unlike what is shown in FIG. 10, however, the input to the switch 401 is connected to a transmission gate 501 and a storage capacitor 503. As should now be apparent, the transmission gate 501 is closed (by sending appropriate control signals to its complementary inputs 505 and 507) at some point in time while $V_{in}$ is at its desired state, such as at some point in time during the line segment 205 shown in FIG. 5. At some point before the value of $V_{in}$ changes, such as before the line segment 281 in FIG. 5, the transmission gate 501 is opened (again, by sending appropriate signals to its complementary inputs 505 and 507), causing the previous value of $V_{in}$ to be stored on the storage capacitor 503 and, in turn, to continue to be input to the control input 403 of the comparator circuit shown in FIG. 10. Through the use of such a configuration, the value of $V_{in}$ is preserved until it is no longer needed.

The invention is also applicable to displays that display video information received in a serial format in the form of a serial video signal, such as the serial video signal typically provided from the VGA port of a personal computer.

Figure 12:
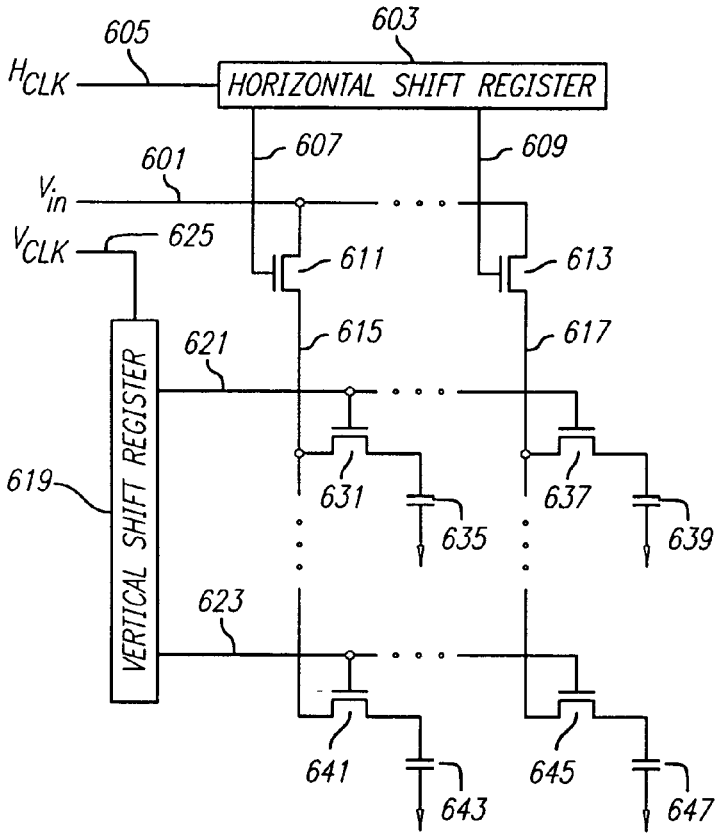
FIG. 12 PRIOR ART
FIG. 12 illustrates a portion of a typical prior art LCD used to display a serial video signal.

FIG. 12 illustrates a portion of the typical prior art LCD that has been used to display a serial video signal. As shown in FIG. 12, a serial video signal $V_{in}$ is delivered to the display over a line 601. As is well known in the art, the voltage of such a signal varies as a function of time and, more precisely, as a function of the anticipated position of a scanning beam in a cathode ray tube (CRT). In order to capture this information, a typical prior art LC display includes a horizontal shift register 603 that shifts a single bit and is driven by a horizontal clock pulse $H_{CLK}$ over a line 605. This causes the outputs of the horizontal shift register, two of which are shown as outputs 607 and 609, to turn on and off in sequence. The outputs of the horizontal shift register, in turn, are typically used to drive switches, such as switches 611 and 613. The outputs of these switches, in turn, drive the respective column lines to which they are attached, such as column lines 615 and 617, respectively.

The vertical shift register 619 similarly controls the activation of the row lines, such as row lines 621 and 623. This is similarly done by shifting a single bit through the register in response to a clocking signal $V_{CLK}$ being delivered over a line 625. The activation of a row line, in turn, activates a switch that is associated with each LC element in the display, such as a switch 631 that is associated with an LC element 635, a switch 637 that is associated with an LC element 639, a switch 641 that is associated with an LC element 643, and a switch 645 that is associated with an LC element 647.

In operation, a first row line is actuated, such as the row line 621. As is well known, this readies the LC elements that are associated with that row to receive a voltage from their associated column lines.

Initially, the horizontal shift register 603 actuates the switch 611 which, in turn, connects the column line 615 to the serial video signal $V_{in}$ over the line 601, thus delivering the serial video signal at this point in time to the LC element 635 in the first row and column. During the next time period, horizontal shift register 603 deactivates the line 607 which, in turn, turns off the switch 611 and thus disconnects the serial video signal $V_{in}$ from the LC element 635. It instead connects the serial video signal $V_{in}$ to the next column line through the next switch (neither of which are shown in FIG. 12). This process proceeds until ultimately the last switch 613 that controls the last column line 617 is actuated and the voltage of the serial video signal $V_{in}$ at that point in time is then delivered to the last LC element 639 in the first row.

The vertical shift register 619 is then actuated by the $V_{CLK}$ signal over the line 625, causing the first row line 621 to be deactuated and, in turn, the next row line (not shown) to be actuated. The voltage on the serial video signal $V_{in}$ is then similarly delivered in sequence to each of the LC elements in the next row. This process continues until the last row line 623 is actuated by the vertical shift register 619 and the LC elements in this last row are set to the voltages dictated at the time of their setting by the serial video signal $V_{in}$.

Although the process of displaying a serial video signal is somewhat different from the process of displaying the parallel video signal discussed above in connection with FIG. 1, the energy wasted during this process is similar and can be substantially reduced through application of the present invention.

Figure 13:
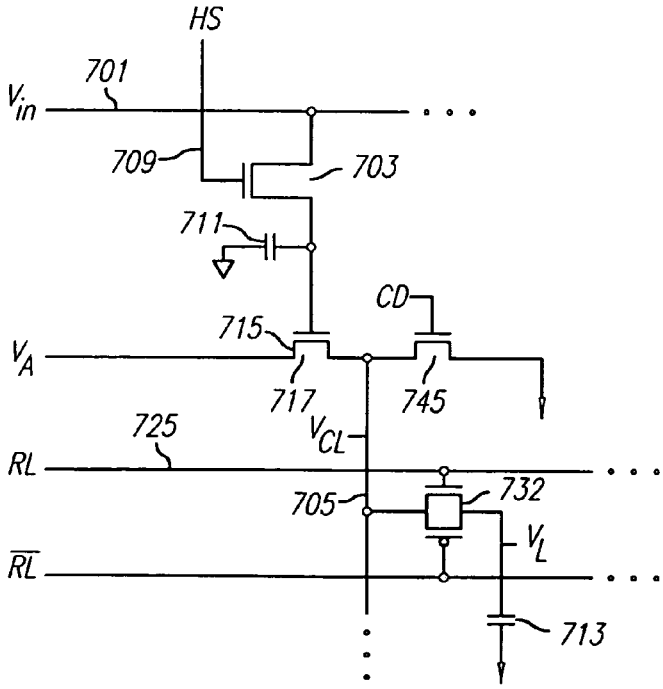
FIG. 13 is a schematic of one embodiment of a circuit that can advantageously be used to implement portions of the invention in connection with a display for a serial video signal.
Figure 14:
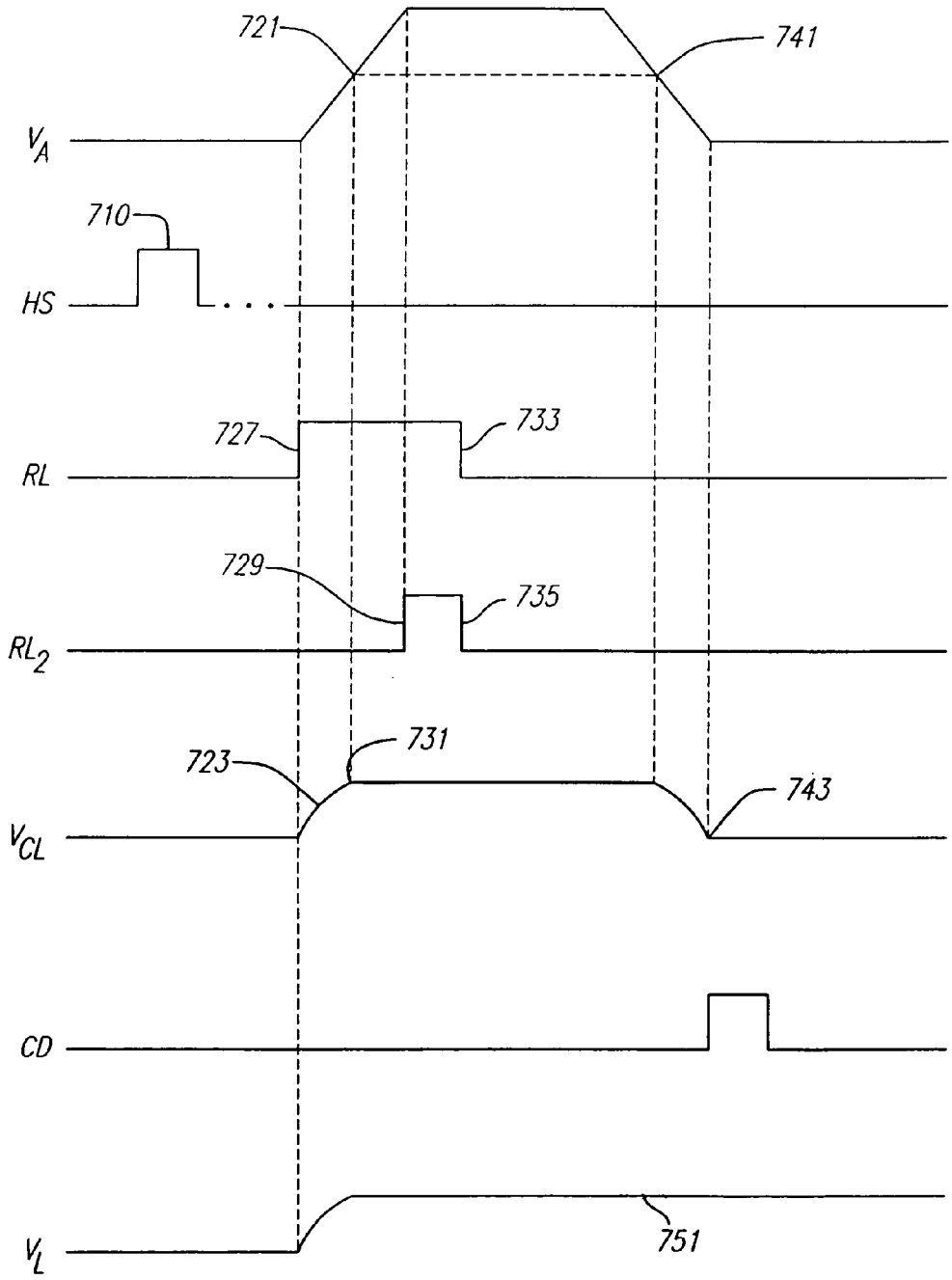
FIG. 14 is a diagram illustrating various signals that are present during the operation of the circuit shown in FIG. 13.

FIG. 13 is a schematic of one embodiment of a circuit that can advantageously be used to implement portions of the invention in connection with a display for a serial video signal. FIG. 14 is a diagram illustrating various signals that are present during the operation of the circuit shown in FIG. 13. The operation of the present invention in connection with a display for a serial video signal is best understood by a discussion of FIGS. 13 and 14 together.

As shown in FIG. 13, the serial video signal $V_{in}$ is delivered over a line 701 to the input of a column storage switch for each column line, such as a column storage switch 703 for a column line 705.

It should be understood that the circuitry shown in FIG. 13 only shows a single LC element in the display, and that this circuitry would typically be duplicated for the other columns in the display. Similarly, the row lines, LC elements, and their associated switches would be duplicated for the other rows in the display. The output of the horizontal shift register HS that corresponds with the column line 705, such as the output 607 from the horizontal shift register 603 shown in FIG. 12, is connected to the input of the switch 703 over a line 709.

As shown by a pulse 710 in FIG. 14, the process in connection with the particular LC element 713 begins by the temporary activation of the output from the horizontal shift register HS that corresponds with the particular column that is being actuated. This signal is delivered over the line 709 to cause the switch 703 to close and, in turn, to cause the voltage of the serial video signal $V_{in}$ to be imposed across a storage capacitor 711. In a preferred embodiment, nothing further is done at this moment to deliver the signal from the serial video signal $V_{in}$ to the LC element 713. Instead, a similar process is employed in connection with all of the other switches and their associated storage capacitors (not shown in FIG. 13) that are associated with the other column lines in the display.

By the end of this process, the voltage that existed on the serial video signal $V_{in}$ at the point in time when a particular column storage switch was actuated is now stored on the capacitor associated with that column switch, such as the capacitor 711 that is associated with the switch 703. After the sweeping of the row is completed and during the retrace period of the serial video signal $V_{in}$, the voltages that were stored on the storage capacitors are then, in turn, transferred to the LC elements that are associated with the storage capacitors in accordance with the process that will now be described.

Preferably, a time-varying source voltage $V_A$ is delivered to an input 715 of a switch 717 that is configured to function as a voltage regulator. Initially, switch 717 is closed, due to the voltage across the capacitor 711. As a consequence, the rising voltage $V_A$ as shown by a line 721 in FIG. 14 is transferred to the column line 705, as shown by a line 723 in FIG. 14. If desired, a row line 725 may be actuated when the voltage source $V_A$ begins to rise, as reflected by a line segment 727 in FIG. 14. Alternatively, the actuation of the row line 725 may be deferred until later, as reflected by a line segment 729 in FIG. 14. In either case, the switch 717 will begin to shut off as the voltage $V_A$ approaches the stored voltage on the capacitor 711, as reflected by a line 731 in FIG. 14. As soon as the voltage across the capacitor 711 is reached (less the threshold voltage across the switch 717), the switch 717 will turn off, leaving the desired voltage on the column line 705 and, in turn, across the LC element 713.

As indicated by the line segment 721 in FIG. 14, a time-varying voltage is preferably used for $V_A$, thus effectuating adiabatic charging. Although a ramp signal has been illustrated, it is of course to be understood that all of the other types of signals discussed above in connected with adiabatic charging may be used instead, such as a half-wave sine pulse or a staircase signal.

After the LC element 713 is fully charged, the row line 725 is typically deactivated, thus disconnecting the LC element 713 from the column line 705 through the operation of a transmission gate 732, as reflected in FIG. 14 by a line segment 733 (or in the alternative a line segment 735).

Next, the energy stored in the other capacitances associated with the column line 705 is recovered. As soon as the voltage source $V_A$ falls below the voltage on the column line 705 (less the threshold in the switch 717), as reflected by a point 741 in FIG. 14, the switch 717 turns on, causing energy that was stored in the other capacitances associated with the line 705 to be returned to the source $V_A$. This process continues until the column line is discharged, as reflected by a point 743 in FIG. 14. Any remaining voltage on the column line 705 is then discharged through the activation of a discharge switch 745 with a column discharge signal CD. This reduces the possibility of noise that might otherwise result because of the then-floating status of the column line 705.

During this energy recovery phase, it is important to note that the voltage that was imposed across the LC element 713 has not changed, as reflected by a line segment 751 in FIG. 14.

As with the charging portion of the process, the discharging segment of the voltage source $V_A$ is also preferably a time-varying signal, thus effectuating adiabatic discharging, as explained above. Again, any other type of time-varying signal could instead be used, such as the staircase signal or half-wave sine pulse discussed above.

In operation, the intrinsic capacitance of the switch 717 will often cause some current to flow between the voltage source $V_A$ and the storage capacitor 711, even when the switch 717 is open. When this happens, the level of voltage that is stored on the storage capacitor 711 will change, potentially introducing an error. To minimize this error, the value of the storage capacitor 711 should be substantial in connection with the intrinsic capacitance of the junction of the switch 717. Alternatively, or in addition, the amount of this error can be calculated and compensated by an offsetting amount being imposed on $V_{in}$. Such an offsetting amount is capable of being provided, for example, by a table in the video driver card that generates the serial video signal $V_{in}$ and/or by appropriate adjustments in the software driver that serves as an interface between the video driver card and the microprocessor of the personal computer.

In many displays, the second plate of each LC element, such as the plates 35, 39, 43 and 47 in FIG. 1, are not connected to ground, but are connected to a DC voltage that lies halfway between ground and the maximum voltage that is expected to be applied to the LC element. During even frames, the other plate of the LC element, such as the other plates 33, 37, 41 and 45 shown in FIG. 1, are driven between this mid-way value and the maximum value. During odd frames, the other plate is driven between zero and the mid-way value.

When using a staircase signal during adiabatic charging and/or discharging in this environment, it is often advantageous to utilize half of the number of steps in the staircase signal, during the period of time when a signal from zero to half of the maximum is needed. In one preferred embodiment, a seven-step staircase signal generator is used to generate the staircase signal during the odd frames, i.e., during the period of time when a signal from zero to half of a maximum is needed; while a fourteen-step staircase signal generator is used to supply the signal during even frames, i.e., during the period of time when a signal between half and the full value is needed. When a fourteen-step staircase signal generator is used, of course, the escalating voltage source is not typically connected to the display until after the seventh step, thus ensuring against an unnecessary interim reversal in polarity across the LC element.

Although having now described certain embodiments of the invention, it is to be understood that the invention is of far broader scope and encompasses components, features, methods, and processes other than those that have been described. For example, the invention is broadly applicable to driving a broad variety of capacitive loads (e.g., capacitive electrostatic transducers and display devices based on electroluminescence or field-emission) to controllable voltage levels, not simply LCDs. Although having thus-far described the charge to each LC element as being delivered through its associated column line, it is, of course, understood that the charge might instead be delivered through its associated row line. In short, the invention is limited solely by the following claims.

What is claimed is:

1. A process for reducing the energy consumed by a display having a plurality of liquid crystal elements, the light passed by each liquid crystal element being regulated by a capacitive element associated with the liquid crystal element, each capacitive element having the ability to be selectively charged by the delivery of current through a line associated with the capacitive element, the line also driving one or more other capacitances in the display other than the capacitive elements, the process comprising:

a) charging a first one of the capacitive elements and at least a portion of the other capacitances by delivering a current through the line associated with the first one of the capacitive elements; and b) recovering energy from the portion of the other capacitances without at the same time recovering energy stored in the first one of the capacitive elements.

2. The process of claim 1 wherein the process is repeated for each of the capacitive elements other than the first one of the capacitive elements and wherein energy is not recovered from any of the capacitive elements during the time that energy is recovered from the other capacitances.

3. The process of claim 1 wherein each capacitive element is connected to the line associated with the capacitive element through an electronic switch.

4. The process of claim 1 wherein adiabatic charging is used to charge the capacitive element.

5. The process of claim 4 wherein the adiabatic charging utilizes a ramp signal.

6. The process of claim 4 wherein the adiabatic charging utilizes a staircase signal.

7. The process of claim 4 wherein the adiabatic charging utilizes a half-wave sine pulse.

8. The process of claim 1 wherein adiabatic discharging is used to recover energy from the other capacitances.

9. The process of claim 8 wherein the adiabatic discharging utilizes a ramp signal.

10. The process of claim 8 wherein the adiabatic discharging utilizes a staircase signal.

11. The process of claim 8 wherein the adiabatic discharging utilizes a halfwave sine pulse.

12. The process of claim 1 wherein the display is a liquid crystal display, an electroluminescence display or a field-emission display.

13. A process for reducing the energy consumed by a display having a plurality of liquid crystal elements arranged in a plurality of rows and columns, the light passed by each liquid crystal element being regulated by a capacitive element associated with the liquid crystal element, each capacitive element having the ability to be selectively charged by the delivery of current through a line associated with the capacitive element, the line also driving one or more other capacitances in the display other than the capacitive elements, the process comprising:

a) charging a first one of the capacitive elements and at least one portion of the other capacitances by delivering a current through the line associated with the first one of the capacitive elements; and b) recovering energy from the portion of the other capacitances without at the same time recovering energy stored in the first one of the capacitive elements or from the capacitive elements that are associated with the liquid crystal elements that are in the same row as the liquid crystal element that is associated with the first one of the capacitive elements.

14. The process of claim 13 wherein the process is repeated for each of the capacitive elements other than the first one of the capacitive elements and wherein energy is not recovered from any of the capacitive elements during the time that energy is recovered from the other capacitances.

15. The process of claim 13 wherein each capacitive element is connected to the line associated with the capacitive element through an electronic switch.

16. The process of claim 13 wherein adiabatic charging is used to charge the capacitive element.

17. The process of claim 16 wherein the adiabatic charging utilizes a ramp signal.

18. The process of claim 16 wherein the adiabatic charging utilizes a staircase signal.

19. The process of claim 16 wherein the adiabatic charging utilizes a halfwave sine pulse.

20. The process of claim 13 wherein adiabatic discharging is used to recover energy from the other capacitances.

21. The process of claim 20 wherein the adiabatic discharging utilizes a ramp signal.

22. The process of claim 20 wherein the adiabatic discharging utilizes a staircase signal.

23. The process of claim 20 wherein the adiabatic discharging utilizes a half-wave sine pulse.

24. The process of claim 13 wherein the display is a liquid crystal display, an electroluminescence display or a field-emission display.

25. A circuit for reducing the energy consumed by a display having a plurality of liquid crystal elements, the light passed by each liquid crystal element being regulated by a capacitive element associated with the liquid crystal element, each capacitive element having the ability to be selectively charged by the delivery of current through a line associated with the capacitive element, the line also driving one or more other capacitances in the display other than the capacitive elements, the circuit comprising:

a) a voltage connection system connected to the line for controllably causing the line to connect to a voltage source;

b) a recovery connection system connected to the line for controllably causing the line to connect to a reservoir; and c) a control system for causing the voltage connection system to connect the line to the voltage source during a first time period and for causing the recovery connection system to connect the line to the reservoir during a second time period, the voltages on the capacitive elements associated with the line not being materially changed during the second time period.

26. The circuit of claim 25 wherein:

a) the source and reservoir constitute a supply that generates a signal that facilitates adiabatic charging and discharging;

b) said voltage connection system includes a first electrical switch ing system connected between the supply and the line;

c) said recovery connection system includes a second electrical switching system connected between the supply and the line; and d) said control system controls said first and second electrical switching systems.

27. The circuit of claim 26 wherein the signal includes a ramp signal.

28. The circuit of claim 26 wherein the signal includes a staircase signal.

29. The circuit of claim 26 wherein the signal includes a half-wave sine pulse.

30. The circuit of claim 26 wherein said first electrical switching system includes a transmission gate connected in series with a MOSFET.

31. The circuit of claim 26 wherein said second electrical switching system includes a MOSFET.

32. The circuit of claim 26 wherein said second time period begins a predetermined amount of time after said first time period.

33. The circuit of claim 26 wherein said second time period begins when the voltage of the signal is approximately equal to the voltage of the line.

34. The circuit of claim 33 further including a comparator circuit connected to the supply and to the line for determining when the voltage of the supply is substantially equal to the voltage of the line.

35. The circuit of claim 25 wherein the display is a liquid crystal display, an electroluminescence display or a field-emission display.

36. A method for driving one of a plurality of pixels of a display and one or more other capacitances that are associated with a line other than the pixels of a display comprising:

a) electrically connecting each of the plurality of pixels of a display to the line;

b) storing charge in the one of the plurality of pixels of a display through the line while each of the other of the plurality of pixels of a display is electrically connected to the line; and c) recovering energy stored in the other capacitances while maintaining the charge stored in the one of the plurality of pixels of a display.

37. A method for driving one of a plurality of pixels of a display as claimed in claim 36, wherein the display is one of a liquid crystal display, an electroluminescence display and a field-emission display.

38. A process for reducing the energy consumed by a display having a plurality of liquid crystal elements arranged in a matrix of rows and columns, the light passed by each liquid crystal element being regulated by a capacitive element associated with the liquid crystal element, each capacitive element having the ability to be selectively charged by the delivery of current through a line associated with the capacitive element, the line also driving one or more other capacitances in the display other than the capacitive elements, each of the plurality of liquid crystal elements being driven to the approximate voltage of a serial video signal, the process comprising:

a) storing the voltage of the video signal for each capacitive element in a storage device;

b) applying the stored voltage for each capacitive element to each capacitive element through a first voltage regulator; and c) recovering energy from the other capacitances.

39. The process of claim 38 wherein adiabatic charging is used in applying the stored voltage.

40. The process of claim 38 wherein adiabatic discharging is used in recovering the energy.

41. The process of claim 38 wherein the first and second voltage regulators constitute the same device.

* * * * *